US008500425B2

(12) United States Patent
Schofield et al.

(10) Patent No.: US 8,500,425 B2
(45) Date of Patent: Aug. 6, 2013

(54) ROOTS PUMPS

(75) Inventors: Nigel Paul Schofield, Horsham (GB); Stephen Dowdeswell, Cuckfield (GB)

(73) Assignee: Edwards Limited (GB)

( * ) Notice: Subject to any disclaimer, the term of this patent is extended or adjusted under 35 U.S.C. 154(b) by 796 days.

(21) Appl. No.: 12/576,871

(22) Filed: Oct. 9, 2009

(65) Prior Publication Data

US 2010/0104464 A1 Apr. 29, 2010

(30) Foreign Application Priority Data

Oct. 24, 2008 (EP) ..... 08167555

(51) Int. Cl.
*F01C 1/18* (2006.01)

(52) U.S. Cl.
USPC ..... 418/205; 418/9; 418/180; 418/206.4

(58) Field of Classification Search
USPC ..... 418/9, 180, 201.1, 206.1–206.4, 418/205
See application file for complete search history.

(56) References Cited

U.S. PATENT DOCUMENTS

| | | | | |
|---|---|---|---|---|
| 1,644,401 | A * | 10/1927 | Ross | 418/206.4 |
| 2,448,901 | A | 9/1948 | McCulloch et al. | |
| 2,531,726 | A * | 11/1950 | Durdin | 418/206.4 |
| 2,831,435 | A * | 4/1958 | Hobbs et al. | 418/206.4 |
| 3,306,228 | A * | 2/1967 | Drutchas | 418/205 |
| 6,283,734 | B1 * | 9/2001 | Blume | 418/206.4 |
| 6,527,530 | B2 * | 3/2003 | Boehland et al. | 418/180 |
| 2006/0083651 | A1 * | 4/2006 | Lim | 418/201.1 |

FOREIGN PATENT DOCUMENTS

| | | | |
|---|---|---|---|
| DE | 3414064 | A1 | 10/1985 |
| EP | 1643129 | A1 | 4/2006 |
| GB | 309685 | * | 4/1929 |
| GB | 856601 | A | 12/1960 |
| GB | 2157370 | A2 | 10/1985 |

* cited by examiner

*Primary Examiner* — Theresa Trieu
(74) *Attorney, Agent, or Firm* — Shumaker & Sieffert, P.A.

(57) ABSTRACT

A Roots vacuum pump stator is arranged to house a pair of intermeshing rotors, said stator being characterized in that it comprises a director or deflector arranged to direct solid material entrained in a gas pumped through the pump towards the outlet. In other words, the stator according to the present invention has a means for directing or deflecting powder or solid material entrained in a gas being pumped directly towards an outlet of the pump or out of the pump. The directing means can comprise a channel disposed between the arcuate surface and the outlet, said channel comprising a portion that engages the arcuate surface prior to the bottom-dead-centre position and which extends away from the rotor's axis of rotation towards the pump outlet. Thus, powder entrained in the pumped gas is effectively removed from pumping volume in a way which reduces the likelihood of any solid material causing the pump to seize: the channel can be arranged so that the solid material is "flung" towards the outlet or away from a meshing zone where rotors mesh with one another.

14 Claims, 6 Drawing Sheets

ROOTS PUMPS

CROSS REFERENCE

This application claims priority to a foreign patent application no. 08167555.5 filed with the European Patent Office on Oct. 24, 2008.

FIELD OF THE INVENTION

The present invention relates to improvements to Roots pumps, including single stage and multi stage roots pumps. In particular, the present invention relates to a stator component and a rotor component of a Roots vacuum pump suitable for use in industrial processes.

BACKGROUND

Vacuum pumps find wide usage throughout industry. For instance, vacuum pumps are used in the semiconductor industry to evacuate a process chamber. The by-products of the process taking place in the chamber can pass through the pump as the gases are evacuated from the chamber. These by-products include substances in vapour, liquid or solid phase and are often "harsh", by which it is meant that the by-products can cause corrosion or wear of pump components exposed to the by-products.

Efforts have been made to improve vacuum pump design so that a pump can better handle by-products of harsh processes. For instance, certain pump components can be made from non-corrosive materials. Furthermore, certain vacuum pump configurations, such as the so-called "hook and claw" or Northey pumps are known to be relatively effective at handling powder entrained in the pumped gases.

A pump's ability to handle powder is an important factor when considering which type of pump should be used for certain processes known to produce powdered by-products. This is a particular problem with some semi-conductor processes where excessive amounts of silica powder are formed in a process chamber and which then pass into the pump evacuating the chamber. In the worse case scenario, the powder can cause a pump to seize and completely malfunction, resulting in potential loss of semiconductor components in the chambers and the chamber having to be taken off-line whilst a replacement pump is fitted and tested. Moreover, the effective operational lifetime of the pump is shortened by excessive exposure to powders.

SUMMARY

The present invention aims to ameliorate the problems of the prior art and provide a Roots-configuration pump suitable for use in the semiconductor industry (but not limited to use in the semiconductor sector, of course) with improved powder-handling capabilities.

To achieve this aim, the present invention provides a Roots pump stator arranged to house a pair of intermeshing rotors, said stator being characterised in that the stator comprises director or deflector arranged to direct solid material entrained in a gas pumped through the stator towards the outlet. In other words, the stator according to the present invention has a means for directing or deflecting powder or solid material entrained in a gas being pumped directly towards an outlet of the pump or out of the pump. This may be achieved by providing a channel disposed in the stator wall that tangentially engages the arc surface of the stator arranged to cooperate with the tip of the Roots rotor. The channel can have a generally flat or linear profile that is angled towards to the pump outlet so that solid material or powder in the pump chamber is encouraged towards the outlet as the rotor rotates. Thus, powder entrained in the pumped gas is effectively removed from the pumping volume in a way which reduces the likelihood of any solid material causing the pump to seize: the channel can be arranged so that the solid material is "flung" towards the outlet or away from a meshing zone where rotors mesh with one another. Alternatively, or in addition, this can be achieved by providing a member that extends above the outlet and has an underside facing the outlet which is so profiled to direct solid material into the outlet.

More specifically, there is provided a Roots pump stator comprising: a pumping volume arranged to accommodate a pair of intermeshing contra-rotating multi-lobed rotors, each being rotatable about an axis such that a tip portion of a rotor lobe can cooperate with the arcuate surface of the stator, and the lobes pass through a top-dead-centre and bottom-dead-centre position with respect to the axis; an inlet disposed above the axis for receiving gas into the pumping volume; and an outlet disposed below the axis for exhausting gas from the pumping volume; characterised in that the stator comprises directing means arranged to direct material entrained in a pumped gas towards the outlet. Also, there is provided a Roots pump stator comprising: a pumping volume arranged to accommodate a pair of intermeshing contra-rotating multi-lobed rotors, each being rotatable about a horizontal axis such that a tip portion of a rotor lobe can cooperate with the arcuate surface of the stator, the arcuate surface having a depth dimension in the plane of the horizontal axis, and the lobes pass through a top-dead-centre and bottom-dead-centre position with respect to the horizontal axis; an inlet disposed above the horizontal axis for receiving gas into the pumping volume; and an outlet disposed below the horizontal axis for exhausting gas from the pumping volume; characterised in that the directing means comprises a channel disposed between the arcuate surface and the outlet, said channel comprising a portion that engages the arcuate surface prior to the bottom-dead-centre position. Thus, powder entrained in the pumped gas is effectively removed from pumping volume in a way which reduces the likelihood of any solid material causing the pump to seize: the channel can be arranged so that the solid material is "flung" towards the outlet or away from a meshing zone where rotors mesh with one another.

Additionally, or alternatively, there is provided a Roots pump stator comprising: a pumping volume arranged to accommodate a pair of intermeshing contra-rotating multi-lobed rotors, each being rotatable about an axis such that a tip portion of a rotor lobe can cooperate with the arcuate surface of the stator, and the lobes pass through a top-dead-centre and bottom-dead-centre position with respect to the axis; an inlet disposed above the axis for receiving gas into the pumping volume; and an outlet disposed below the axis for exhausting gas from the pumping volume; characterised in that the stator comprises a deflector disposed at the outlet which is arranged to direct material passing through the pumping volume towards the outlet. Also, there is provided a Roots pump stator comprising: a pumping volume arranged to accommodate a pair of intermeshing contra-rotating multi-lobed rotors, each being rotatable about a horizontal axis such that a tip portion of a rotor lobe can cooperate with the arcuate surface of the stator, the arcuate surface having a depth dimension in the plane of the horizontal axis; an inlet disposed above the horizontal axis for receiving gas into the pumping volume; and an outlet disposed below the horizontal axis for exhausting gas from the pumping volume; characterised in that the directing means comprises a deflector disposed at the outlet which is arranged to direct material passing through the pumping volume towards the outlet. Thus, powder entrained in the pumped gas is effectively removed from pumping volume in a way which reduces the likelihood of any solid material causing the pump to seize: the deflector is arranged so that the solid material is directed or deflected towards the outlet or away from a meshing zone where rotors mesh with one another.

Additionally, the portion of the channel can be disposed to tangentially engage the arcuate surface at between 5 to 45 degrees in advance of bottom-dead-centre, or between 5 to 25 degrees in advance of bottom-dead-centre or at a position 15 degrees in advance of bottom-dead-centre. As a result, any entrained powder can be thrown radially away from the rotors so that it does not become trapped between the intermeshing rotors.

Additionally, at least one deflector surface can be disposed between the first portion of the channel and the outlet. The deflector surface can be angled towards the outlet and arranged to direct material passing through the pumping volume towards the outlet. The deflector surface also can be arranged to extend across width of the channel to form a closed channel.

Additionally, the deflector has an upper surface which forms a portion of the arcuate surface between the channel and the outlet.

The present invention also provides a multi-staged vacuum pump comprising a stator as described above and a rotor component comprising a plurality of rotor elements arranged to cooperate with a respective plurality of stator stages, wherein each rotor element comprises a lobe portion arranged to cooperate with a portion of the stator, each lobe portion having at least one axial groove disposed at or near its tip, furthest from an axis of rotation.

BRIEF DESCRIPTION OF THE DRAWINGS

Embodiments of the present invention are now described, by way of example and with reference to the accompanying drawing, of which.

DETAILED DESCRIPTION

Figure 1:
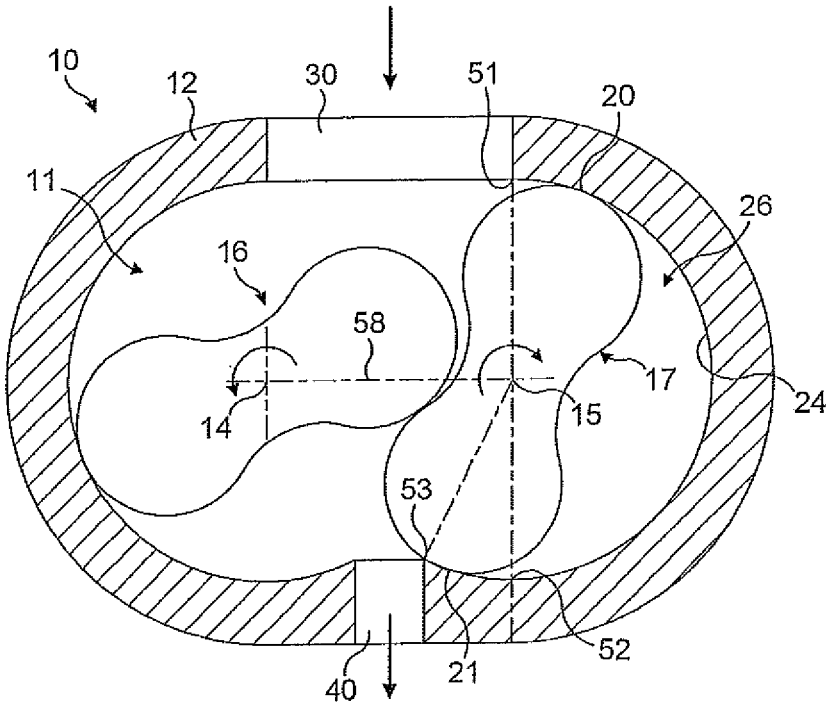
FIG. 1 (Prior Art)
FIG. 1 is a cross-section of a known Roots pump.

FIG. 1 shows a cross section of a Roots pump 10 known in the art and described in WO2007/088103. The pump comprises a pumping volume 11 defined by a stator body 12. A pair of contra-rotating intermeshing multi-lobed rotors 16, 17 are arranged to rotate about respective horizontal axes 14 and 15. The pump in FIG. 1 has two lobes on each rotor and tip portions 20 and 21 of the lobes are arranged to cooperate with an arcuate inner surface 24 of the stator, thereby trapping a volume of gas 26 between the rotor and stator 12. Gas is pumped from an inlet 30 to an outlet 40 by the counter rotational movement of the rotors.

Each tip portion 20, 21 of the lobes pass through a top-dead-centre position 51 and bottom-dead-centre position 52 during its rotation cycle. Typically, the top-dead-centre position is after or coincides with a point where the arcuate inner surface 24 meets the pump's inlet 30. Furthermore, the bottom-dead-centre position 52 is in advance of a point where the inner arcuate surface 24 meets the outlet. This arrangement provides efficient pumping of gas because volume of gas 26 remains trapped between the rotor and stator for sufficient time to allow proper operation of the pump. Conventionally, for a two-lobed rotor the points where the stator inner wall 24 meets the inlet and outlet should be more than 180° apart otherwise effective compression of the pumped gases may not occur.

Figure 2:
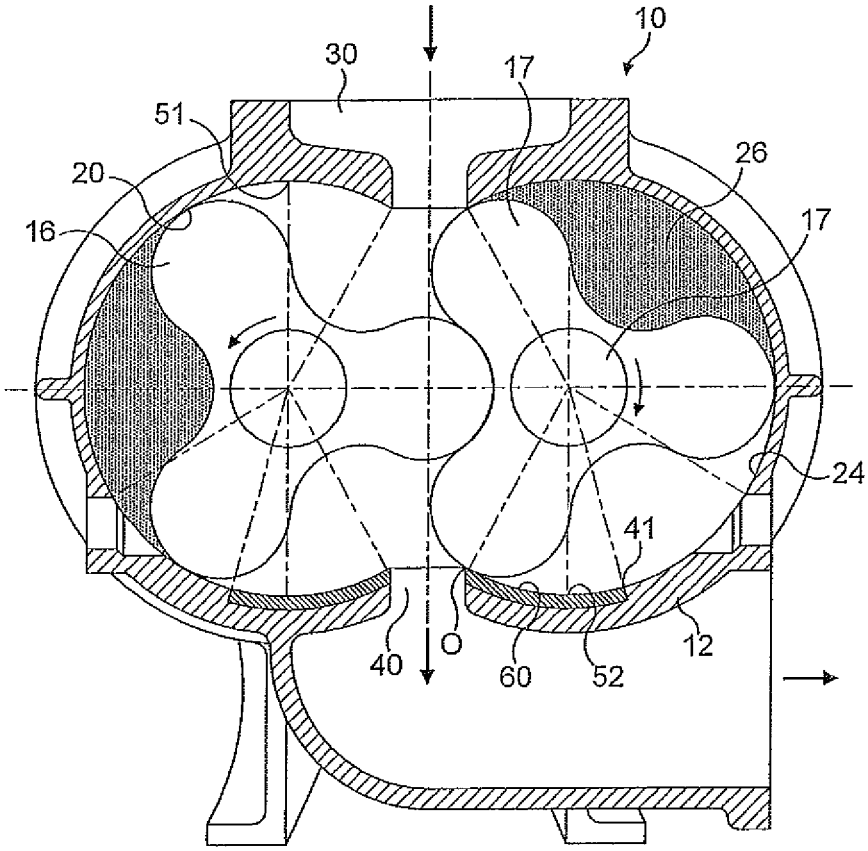
FIG. 2 (Prior Art)
FIG. 2 is a cross-section of another known Roots pumps.

FIG. 2 shows a cross section of another known Roots vacuum pump described in U.S. Pat. No. 7,226,280. This figure shows a three-lobed rotor configured Roots pump where the same reference numerals have been used to indicate the same or similar components. In addition, the inner arcuate surface 24 comprises a plurality of constant depth grooves 60 cut into the inner surface 24. The grooves are formed at a point 41 prior to the bottom-dead-centre position 52 and extend to the outlet 40. The purpose of these grooves is to release of portion of the pumped gas 26 trapped between the rotor and stator at a relatively early stage of the rotation cycle in an attempt to reduce any noise associated with the pumped gases exhausting from the output.

Both of the prior art pumps described above can suffer from problems when the gas being pumped contains a powder substance. The powder tends to become trapped between the pump components and ultimately causes the pump to seize. Thus, the limit of powder that can be handled by Roots vacuum pumps without pump seizure is relatively small and of the order of 50-100 grams of a silica powder load for a pump having a pump-rating of 100 cubic meters per hour.

Figure 3:
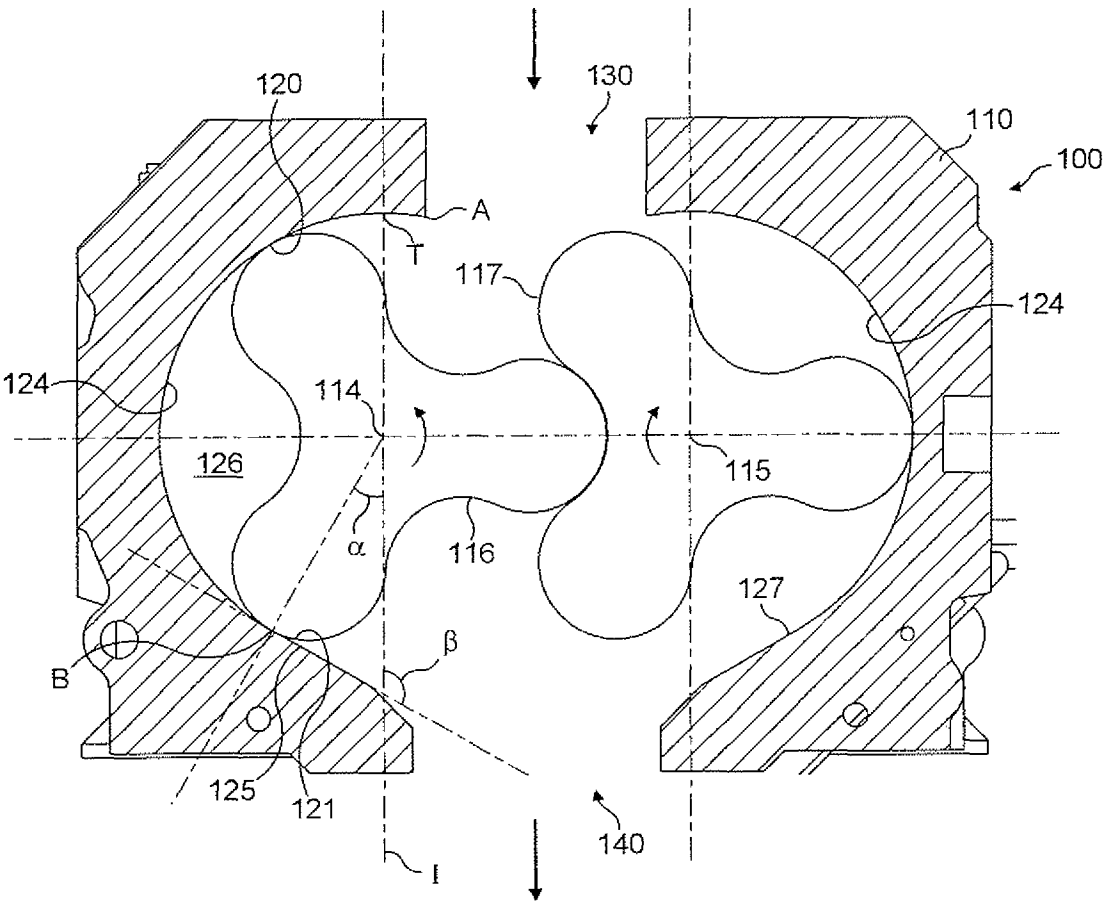
FIG. 3 is a cross-section of a Roots pump component embodying the present invention.

FIG. 3 shows a cross sectional diagram of a pump 100 embodying the present invention. The pump comprises a stator 110 embodying the invention which provides a pumping volume and which is arranged to accommodate a pair of intermeshing contra-rotating multi-lobed rotors 116 and 117, each rotatable about horizontal axes 114 and 115. The rotors in FIG. 3 are shown to have three lobes, but it is understood that the invention is not limited to this arrangement and the inventive concept can apply to any number of rotor lobe configurations.

The stator 110 comprises an inner wall or surface 124 which follows an arc path between points A and B. During use, the rotor's lobe tip portions 120 and 121 cooperate with the inner surface 124 to trap pumped gas in a volume 126 between the rotor and stator. In practice, during use the tips of the rotors have a relatively small clearance between the tip and stator arc surface. Point A of the inner surface 120 is arranged to be in front of the top-dead-centre position T with respect to the direction of rotation for the rotor.

However, in contrast to the known Roots pump systems described previously, at least a portion 125 of the inner surface, between point B and the outlet of the pump, is arranged to follow a different path which does not continue along or parallel with the arcuate path of the inner surface 124. In the embodiment shown in FIG. 3, this stator outlet portion 125 follows a path that is substantially linear, it follows a tangent of the arcuate inner surface, and extends away from the axis of rotation towards the output 140 of the pump. In other words, point B is disposed prior to the bottom-dead-centre position of the rotor lobe and the depth of a channel forming the outlet portion 125 increases from point B (where the channel engages the arcuate inner surface 124 of the stator) towards the outlet. In the embodiment shown in FIG. 3, the outlet portion of the stator, or channel, extends away from the axis of rotation in a linear manner, or having a linear cross-section when viewed in the plane of the rotor's rotation. It is understood that the channel can extend away from the axis is a non-linear manner, for instance by following a radius centred inside or outside of the pumping volume or by following a step profile or the like.

Point B can be arranged to be at bottom-dead-centre or within a range of angles in advance of bottom-dead-centre. For instance, Point B can be arranged to be between 5 to 45 degrees in advance of bottom-dead-centre, as indicated by angle $\alpha$ in FIG. 3. Preferably, $\alpha$ can be between 5 to 25 degree, and more preferably $\alpha=15°$. If the initial part of the outlet portion 125 of the stator inner surface 124 is tangential to arcuate portion of the inner surface, then an angle $\beta$ between an imaginary line I (passing through the top-dead-centre and bottom-dead-centre positions) and the tangent formed at point B follows the equation $\beta=90+\alpha$. Thus, it follows that $135° \leqq \beta \leqq 90°$.

It has been found that outlet portion 125 of the stator acts as a means for directing particulates or powder passing through the pump towards the outlet 140. Any particulates entrained in the pumped gas are flung by centrifugal forces towards the arcuate surface 124 as the rotors drive the pumped gas through the pump. Thus, particulates in the gas are directed towards the outlet 140 and away from a zone 145 where the rotors mesh with one another because the outlet portion 125 generally slopes towards the outlet 140 of the pump or pumping stage.

As a result of this arrangement embodying the present invention, we have determined that conventional Roots pumps as described above have poor powder handling capabilities because of the profile of the stator's outlet portion: a conventional Roots pump stator can cause at least some particulates entrained in the pumped gas to be forced or thrown towards a meshing zone of the rotors. Thus, a portion of the powder entrained in the pumped gas passing through a conventional pump can be re-circulated through the pump. If significant amounts of powder enter the zone where the rotors mesh, then pump seizure can occur.

Figure 4:
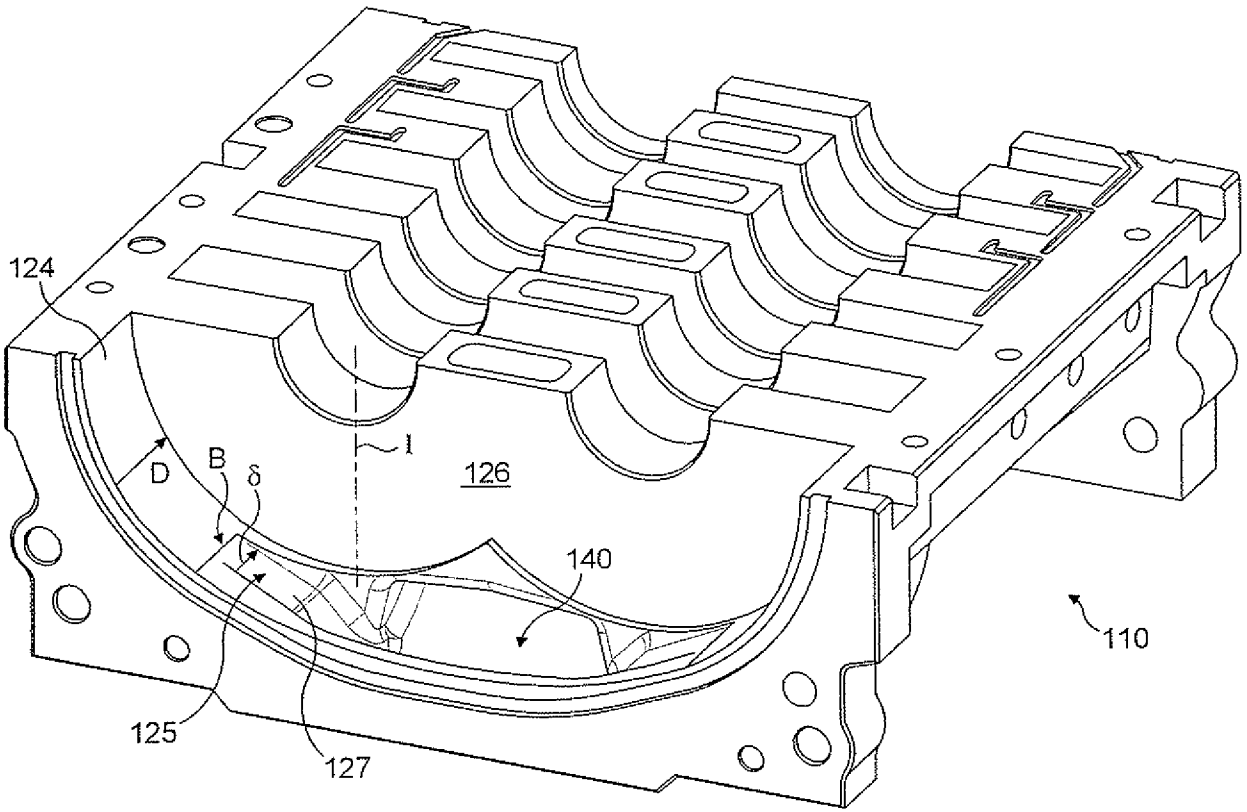
FIG. 4 is an isometric view of a portion of a Roots pump stator embodying the present invention.

FIG. 4 is an isometric view of a portion of a Roots pump stator 110 embodying the present invention. The stator is formed of a plurality of pumping stages, as is known in the art. In this embodiment, the stator is formed in a "clam-shell" configuration and only the bottom portion of the complete stator is shown for clarity. It is also understood that stator end-plates (not shown) are utilised in the complete pump.

Imaginary line I is shown projected against a stator side wall 126. The start of the outlet portion 125 of the stator wall 124 is advanced from a position where a rotor passes through a bottom-dead-centre position. Furthermore, the floor 127 of the outlet portion 125 has a width dimension $\delta$ that is less than a width dimension D of the arcuate stator inner surface 124. It is envisaged that the ratio of D:$\delta$ can be in the range of 2:1 to 10:11 (that is 50% to 110%). In other words, if excessive amounts of powder in the pump are anticipated then having width dimension that is greater than the stator depth dimension could assist with improving effective handling of powder.

Other configurations of stator output or outlet portions are envisaged, either in addition to the above described embodiments or as an alternative, and the present invention is not limited to linear configuration described above. For instance, the outlet portion can be arranged to follow a path having a radius that is greater than the radius of the inner stator surface 124. It is preferable that the distance between the floor or bottom of the outlet portion and the contact portion of the rotor lobe increase from a few microns at point B to at least 1 cm at the outlet. Furthermore, the width of the outlet portion can be arranged to vary and preferably increase towards outlet. The outlet portion can be configured to include a plurality of grooves cut into stator inner surface.

Figure 5:
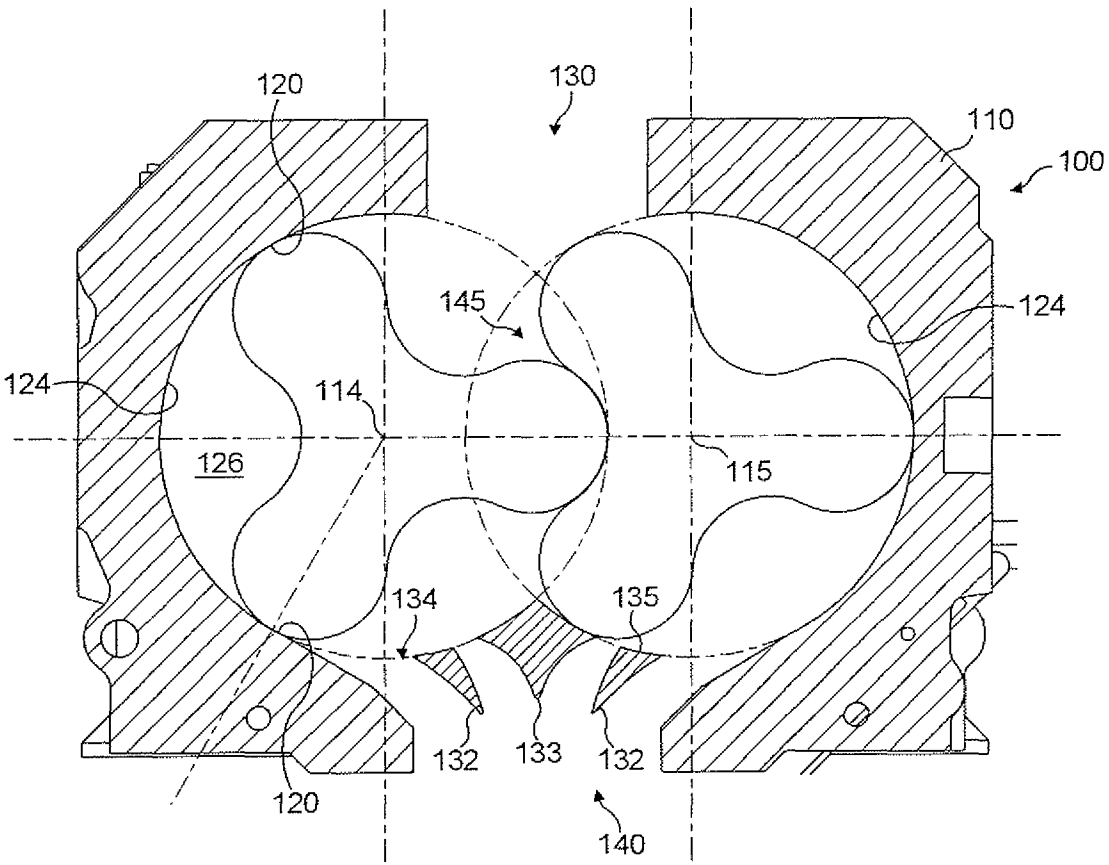
FIG. 5 is another cross-section of a Roots pump component embodying the present invention.

Further means for directing dust, powder or particulates entrained in the pump gas towards the outlet of the pump or pump stage are now described with reference to FIG. 5. In one embodiment vein member 132 is disposed above the outlet portion of the stator. The vein extends across the outlet portion, either completely or partially across the outlet port, and has a surface facing the outlet that is angled towards the outlet 140 in order to deflect particulates entrained in the pumped gas towards to outlet 140. A relatively small clearance is provided between the vein and the path 134 taken by the tip portion 120 of the rotor's lobe. In another embodiment, a directing member 133 can be configured as a central component disposed directly above the outlet 140 having two opposed surfaces facing the outlet, each arranged to direct powdered material towards the outlet from each rotor respectively. In this way, at least a portion of particulates entrained in the gas being pumped can be deflected towards the outlet 140 and before they would otherwise enter a meshing zone 145 where the rotors mesh. An upper surface 135 of the vein or deflector can be arranged to form a portion of the arcuate surface 124. The upper surface can be arranged to extend to, but not enter, the meshing zone 145.

Our experiments have shown that powder handling capabilities of a pump having a stator configuration embodying the present invention are greatly improved without affecting the pumping capability to a significant degree. For instance, we have noted improvements of up to 400%, where a pump rated at 100 meters cubed per hour can efficiently handle a powder load of 400 grams without seizure.

Figure 6:
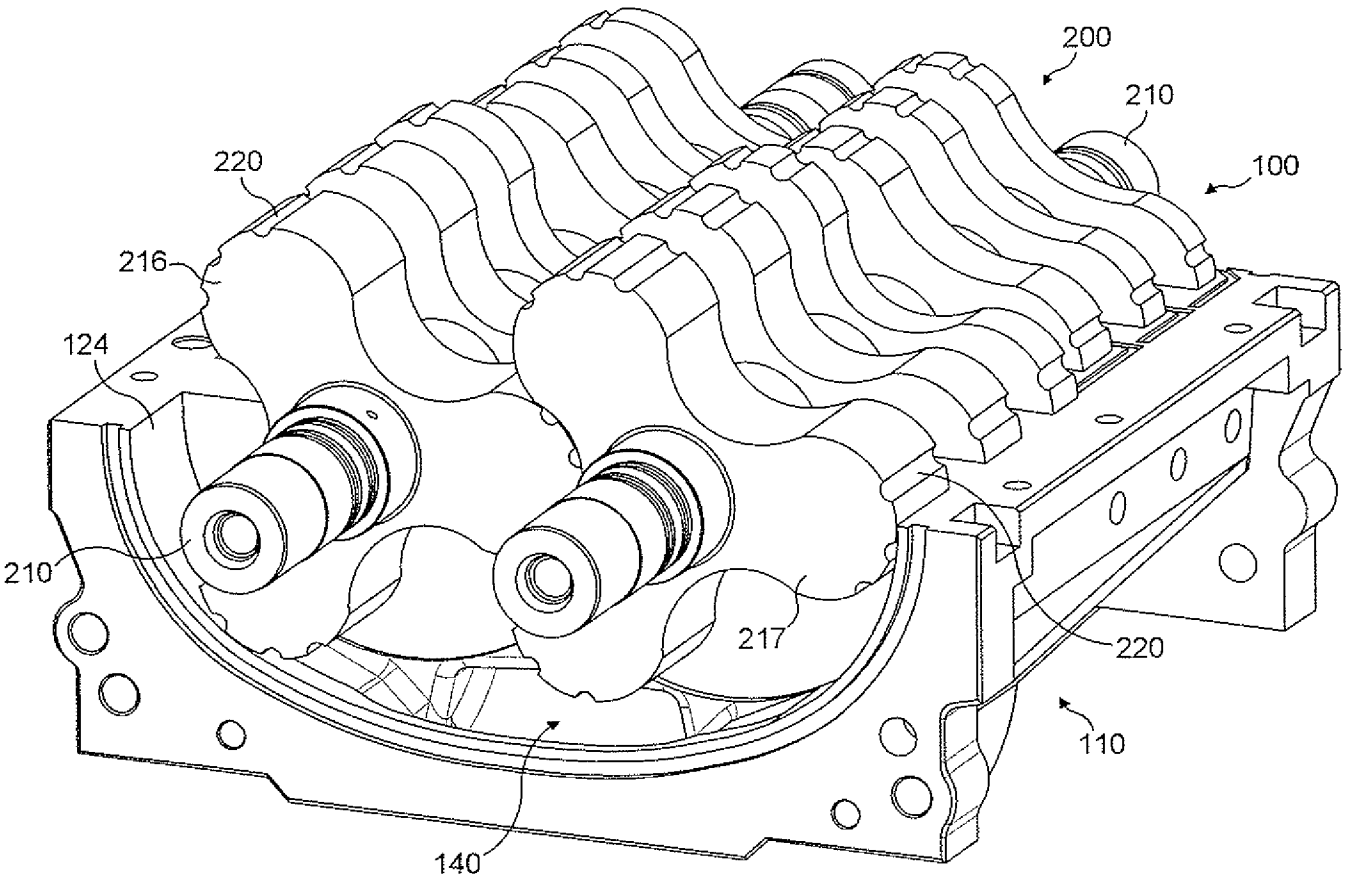
FIG. 6 is an isometric view of a portion of a Roots pump rotor and stator embodying the present invention.

Referring now to FIG. 6, a pump 100 embodying the present invention is shown. One half of a stator clamshell 110 is shown and is described above with reference to FIG. 3, 4 or 5. In addition, a pair of rotors 200 is shown. Each rotor comprises a shaft 210 and rotor elements having multiple lobes 216, 217. The tip portions of the lobes comprise axial grooves 220, which we have found to improve the powder handling capability of Roots pumps. By disposing the grooves on each stage of a multi-staged Roots pump, the powder handling can be further improved. In the embodiment shown in FIG. 6, each tip portion comprises three grooves. However, it is understood that other embodiments can comprise any number grooves, which can be arranged into any configuration where a number of grooves are disposed fore or aft of the point where the tip portion of the rotor lobe cooperates with the stator inner arcuate surface 124. For instance, a middle groove can be disposed adjacent the point where the rotor lobe and stator cooperate, with one groove disposed in a leading position and another groove disposed in a trailing position, respectively. Other combinations of numbers of grooves (one, two, or more) per lobe and their respective positions will be envisaged by the skilled person. Also, the number of grooves is likely to depend on the pump application or process being pumped.

Other embodiments of the present invention will be envisaged by the skilled person without departing from the scope of inventive concept.

We claim:

1. A Roots pump stator comprising:

a pumping volume arranged to accommodate a pair of intermeshing contra-rotating multi-lobed rotors, each being rotatable about an axis such that a tip portion of a rotor lobe cooperates with the arcuate surface of the stator, and the lobes pass through a top-dead-centre and bottom-dead-centre position with respect to the axis;

an inlet disposed above the axis for receiving gas into the pumping volume; and an outlet disposed below the axis for exhausting gas from the pumping volume;

wherein the stator comprises a channel disposed in the arcuate surface between the arcuate surface and the outlet, wherein said channel tangentially engages the arcuate surface at a point prior to the bottom-dead-centre position.

2. A device according to claim 1, wherein the point where the channel engages the arcuate surface is between 5 to 45 degrees in advance of bottom-dead-centre.

3. A device according to claim 1, wherein a depth dimension of the channel in a radial direction with respect to the axis increases from the point where the channel engages the arcuate surface towards the outlet.

4. A device according to claim 1, wherein the stator is configured as either a multi-stage Roots pump, or a single stage Roots pump.

5. A multi-staged vacuum pump comprising a stator according to claim 1 and a rotor component comprising a plurality of rotor elements arranged to cooperate with a respective plurality of stator stages, wherein each rotor element comprises a lobe portion arranged to cooperate with a portion of the stator, each lobe portion having at least one axial groove.

6. A device according to claim 1, wherein the point where the channel engages the arcuate surface is between 5 to 25 degrees in advance of bottom-dead-centre.

7. A device according to claim 1, wherein the point where the channel engages the arcuate surface is 15 degrees in advance of bottom-dead-centre.

8. A Roots pump stator comprising:

a pumping volume arranged to accommodate a pair of intermeshing contra-rotating multi- lobed rotors, each being rotatable about an axis such that a tip portion of a rotor lobe cooperates with the arcuate surface of the stator, and the lobes pass through a top-dead-centre and bottom-dead-centre position with respect to the axis;

an inlet disposed above the axis for receiving gas into the pumping volume; and an outlet disposed below the axis for exhausting gas from the pumping volume;

wherein the stator comprises a deflector disposed at the outlet which is arranged to direct material passing through the pumping volume towards the outlet and that the stator comprises a channel disposed in the arcuate surface between the arcuate surface and the outlet, wherein said channel tangentially engages the arcuate surface at a point prior to the bottom-dead- centre position.

9. A device according to claim 8, wherein the point where the channel engages the arcuate surface has a width dimension in the plane of the axis, and the width of the channel increases towards the outlet.

10. A multi-staged vacuum pump comprising a stator according to claim 8 and a rotor component comprising a plurality of rotor elements arranged to cooperate with a respective plurality of stator stages, wherein each rotor element comprises a lobe portion arranged to cooperate with a p0ltion of the stator, each lobe portion having at least one axial groove.

11. A Roots pump stator comprising:

a pumping volume arranged to accommodate a pair of intermeshing contra-rotating multi-lobed rotors, each being rotatable about an axis such that a tip portion of a rotor lobe cooperates with the arcuate surface of the stator, and the lobes pass through a top-dead-centre and bottom-dead-centre position with respect to the axis;

an inlet disposed above the axis for receiving gas into the pumping volume;

an outlet disposed below the axis for exhausting gas from the pumping volume;

a channel disposed in the arcuate surface between the arcuate surface and the outlet, wherein said channel tangentially engages the arcuate surface at a point prior to the bottom-dead-centre position; and a deflector disposed at the outlet which is arranged to direct material passing through the pumping volume towards the outlet.

12. A device according to claim 11, wherein the deflector extends across a width of the channel to form a closed channel.

13. A device accoridng to claim 11, wherein the deflector has an upper surface which forms a portion of the arcuate surface between the channel and the outlet.

14. A device according to claim 13, wherein the upper surface forming a portion of the arcuate surface that extends to a meshing zone where rotors mesh with one another.

* * * * *